US010190814B2

(12) United States Patent
Szprengiel et al.

(10) Patent No.: US 10,190,814 B2
(45) **Date of Patent: *Jan. 29, 2019**

(54) CONDENSATE EVAPORATOR FOR REFRIGERATION APPARATUS

(75) Inventors: Stanley Szprengiel, Jackson, NJ (US); Thomas Graham, Ocean, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 1169 days.

This patent is subject to a terminal disclaimer.

(21) Appl. No.: 13/298,768

(22) Filed: Nov. 17, 2011

(65) Prior Publication Data

US 2013/0125575 A1 May 23, 2013

(51) Int. Cl.

| | |
|---|---|
| ***F25D 21/00*** | (2006.01) |
| ***H05B 3/44*** | (2006.01) |
| ***F25D 21/08*** | (2006.01) |
| ***H05B 3/48*** | (2006.01) |
| ***H05B 3/82*** | (2006.01) |

(52) U.S. Cl.

CPC ..... *F25D 21/08* (2013.01); *H05B 3/48* (2013.01); *H05B 3/82* (2013.01); *H05B 2203/021* (2013.01)

(58) Field of Classification Search

CPC ..... F25D 2321/14; F25D 2321/141; F25D 2321/143; F25D 2321/144; F25D 2321/1441; F25D 2321/1442; F25D 2321/147; F25D 21/14; F25D 2321/1413; H05B 1/0222; H05B 1/0269; H05B 3/18; H05B 3/0071

USPC ..... 62/272, 275, 291, 285, 276; 219/538, 219/438, 544

See application file for complete search history.

(56) References Cited

U.S. PATENT DOCUMENTS 1,718,518 A * 6/1929 Barnett ..... H01R 27/02 439/652
2,391,038 A * 12/1945 Rifenbergh ..... H01F 27/008 174/527
2,759,335 A * 8/1956 Weschler, Jr. ..... F24F 13/22 62/150
2,956,417 A * 10/1960 Lyman ..... F24F 13/22 200/61.07
3,280,580 A * 10/1966 Costantini ..... F25D 21/14 261/142
3,387,653 A * 6/1968 Coe ..... F28F 1/12 165/165
3,679,867 A * 7/1972 Canter ..... F25D 21/14 392/402
3,683,153 A * 8/1972 Heyer ..... F25D 21/14 219/439
3,836,713 A * 9/1974 Halvorson, Sr. ..... A47J 31/053 219/436
4,052,590 A * 10/1977 Anderl ..... A47J 27/004 219/438

(Continued)

*Primary Examiner* — Ljiljana V. Ciric
*Assistant Examiner* — Kirstin U Oswald
(74) *Attorney, Agent, or Firm* — Francis C. Hand; Carella, Byrne et al

(57) ABSTRACT

The condensate evaporator has a pan for collecting condensate and a heating element that is integral with the pan. The heating element includes a U-shaped copper tube and an electrically conductive wire that extends through the tube with each end thereof extending from the tube for connection to an electrical circuit.

4 Claims, 4 Drawing Sheets

(56) References Cited

U.S. PATENT DOCUMENTS

| | | | | | |
|---|---|---|---|---|---|
| 4,254,311 | A * | 3/1981 | Sisk, Jr. | H01H 35/18 | 200/61.07 |
| 4,554,794 | A * | 11/1985 | Khan | F25D 21/14 | 2/137 |
| 5,072,095 | A * | 12/1991 | Hoffman | A47J 36/2461 | 219/432 |
| 5,551,250 | A * | 9/1996 | Yingst | F25B 47/022 | 62/234 |
| 5,694,785 | A * | 12/1997 | Balentine | F24F 13/22 | 62/274 |
| 5,966,958 | A * | 10/1999 | Maynard | F24F 13/224 | 62/277 |
| 6,167,716 | B1 * | 1/2001 | Fredrick | F24F 13/222 | 62/283 |
| 2004/0084439 | A1 * | 5/2004 | Galliou | H05B 3/48 | 219/465.1 |
| 2009/0188231 | A1 * | 7/2009 | Song | H05B 3/56 | 57/362 |
| 2009/0188321 | A1 * | 7/2009 | Schoen | G01D 11/245 | 73/632 |

* cited by examiner

CONDENSATE EVAPORATOR FOR REFRIGERATION APPARATUS

This invention relates to a condensate evaporator for refrigeration apparatus. More particularly, this invention relates to a condensate evaporator for large walk-in refrigerators.

As is known, large walk-in refrigerators are provided with condensate evaporators in order to collect and evaporate condensate that accumulates during operation of the refrigerators.

Generally, condensate evaporators for large walk-in refrigerators have been constructed to be slid into a space below a raised floor of the refrigerator to collect the condensate that forms during operation. Usually, the floor has been provided with a drain hole so that the evaporator pay receive the condensate directly. These condensate evaporators typically employ electric heaters to evaporate the collected condensate.

A known condensate evaporator is presently constructed to use a "Balco" resistance wire in the heater. This wire when cold (when water is in the evaporator) has a low resistance and thus draws a high current in this state. After the water is all evaporated, the temperature of the wire increases, and so does the resistance of the wire, thus now drawing somewhat less power, though still using some electricity in this state. The wire is, thus "on" continuously 24/7 drawing this reduced amount of power unless more condensate enters the evaporator, cooling the wire, and then the wire returns to its lower resistance/higher current mode until the water is again evaporated. At all times, the heater is drawing power either at the full rate or at the reduced rate.

U.S. patent application Ser. No. 12/806,571, filed Aug. 17, 2010, describes a condensate evaporator for refrigeration apparatus having a pan in which condensate may be collected and which is pivotally mounted to pivot towards one end of the pan under the weight of condensate in the pan. In addition, a heater pad is provided on the pan for heating condensate in the pan to a point of evaporation and a plunger type push button switch is mounted at the end of the pan toward which the pan is able to pivot under the weight of condensate in the cavity of the pan. The switch is normally in the off position, but turns on when a predetermined weight of water accumulates in the pan and pivots the pan so as to cause the plunger of the switch to recede to a retracted position allowing power to be sent to the heater pad. After a sufficient amount of water has evaporated, a spring within the switch extends the plunger to an extended position thereby permitting the switch to turn off.

As described, the pan is provided with a recess to receive the heater pad and a silicone foam pad and which is closed by a cover plate screwed to the underside of the pan to close off the recess to the outside environment.

Accordingly, it is an object of the invention to provide a condensate evaporator that is economical to manufacture.

It is another object of the invention to provide a condensate pan that can be heated using a minimum of parts.

Briefly, the invention provides a condensate evaporator for refrigeration apparatus that has a pan for collecting condensate and a heating element that is integral with the pan, i.e. that is, where the pan is made of a cast metal, the heating element is cast with the pan.

The pan is cast with a floor and upstanding walls that extend from the floor to define a cavity for receiving condensate.

The heating element includes a U-shaped copper tube and an electrically conductive wire, e.g. a wire that is coiled within the tube and that extends through the tube with each end thereof extending from the tube for connection to an electrical circuit. The heating element is of a size to be able to heat and evaporate the condensate in the pan upon being electrically energized.

The heating element also includes a potting material for receiving and insulating the coiled wire electrically from the copper tube During manufacture, the heating element is made by first potting the coiled wire within a straight copper tube and then bending the tube into a U-shape with two ends bent, e.g. at a 90° to the remainder of the tube.

The heating element is then cast with the pan to be integral therewith. Consequently, the unit of pan and heating element can be economically manufactured as opposed to being separate pieces that require subsequent assembly operations.

The pan is also cast to have a pair of posts on an underside of the floor for pivoting of the pan on a surface about a horizontal axis passing through the posts towards one end of the pan under the weight of condensate in the cavity and a plunger type push button switch mounted at the end of the pan toward which the pan is able to pivot under the weight of condensate in the cavity of the pan.

The switch is positioned on the underside of the pan so that the two posts and switch support the pan at three points. The switch has a movably mounted plunger for movement between an extended position corresponding to a raised position of the end of the pan relative to the support surface and a retracted position corresponding to a lowered position of the end of the pan relative to the support surface. In this regard, the plunger is spring loaded by a spring that has a spring constant sufficient to support the pan with the two studs in a horizontal position on the support surface but insufficient to prevent the pan from pivoting about the two studs under the added weight of a predetermined amount of condensate in the pan. Once the pan has been emptied of this added amount of condensate, the spring returns the plunger to its extended position.

The condensate evaporator also includes an electrical circuit that electrically connects the heating element and switch to an electrical supply whereby electrical power is supplied to the heating element with the plunger of the switch in the retracted position and the electrical supply is interrupted to the heating element with the plunger in the extended position thereof.

The switch is normally in the off position, but turns on when a predetermined weight of water accumulates in the pan and pivots the pan so as to cause the plunger of the switch to recede to the retracted position thus sending power to the heater. After a sufficient amount of water has evaporated, the spring within the switch extends the plunger to its extended position thereby permitting the switch to turn off.

These and other objects and advantages of the invention will become more apparent from the following detailed description taken in conjunction with the accompanying drawings wherein.

Figure 1:
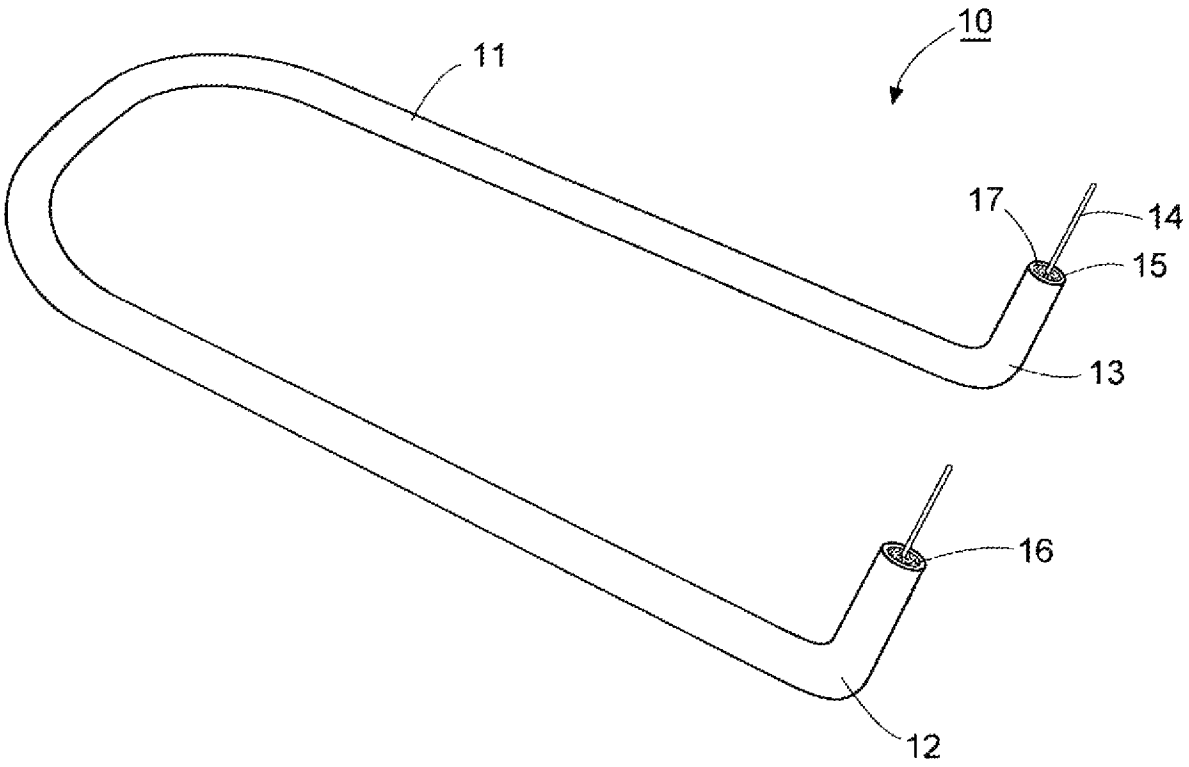
FIG. 1 illustrates a perspective view of a heating element in accordance with the invention.

Referring to FIG. 1, the heating element 10 includes a U-shaped copper tube 11 having a pair of bent ends 12, 13, e.g. bent at a 90° angle to the remainder of the tube 11, and an electrically conductive wire 14, e.g. in the form of a coiled wire, extending through the tube 11 with each end 15, 16 thereof extending from the tube 11 for connection to an electrical circuit (not shown). In addition, the heating element 10 has a potting material 17 for receiving and insulating the coiled wire 14 electrically from the copper tube 11, known as a BALCO® wire that changes resistance with changes in temperature.

Figure 2:
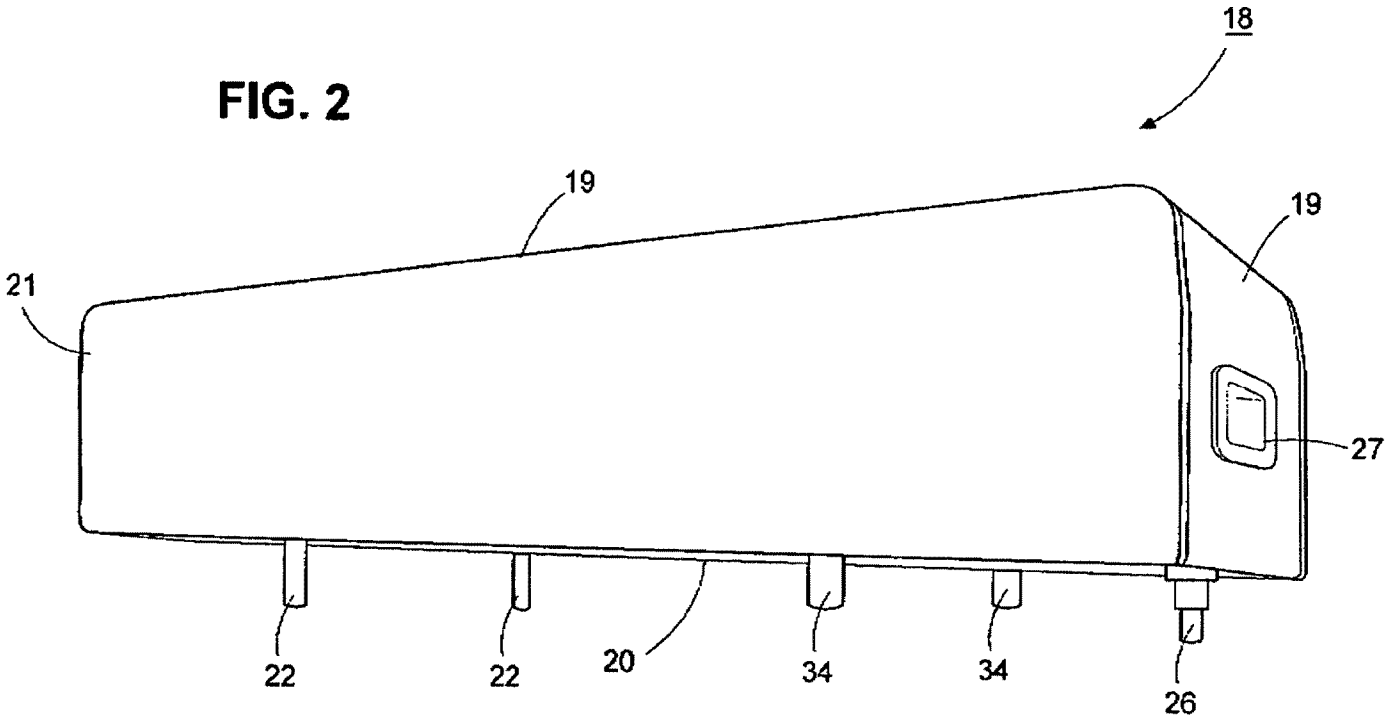
FIG. 2 illustrates a perspective view of a condensate evaporator in accordance with the invention with the heating element of FIG. 1 in place.

Referring to FIG. 2, the condensate evaporator 18 is constructed as described in the above mentioned U.S. patent application Ser. No. 12/806,571, the disclosure of which is incorporated by reference herein. The condensate evaporator 18 is constructed for use in refrigeration apparatus for collecting and evaporating condensate that forms within the refrigeration apparatus.

As indicated, the condensate evaporator 18 has a pan 19 having a floor 20, upstanding walls 21 extending from the floor 20 to define a cavity for receiving condensate therein and a pair of posts 22 on an underside of the floor for pivoting of pan 19 on a surface about a horizontal axis passing through the posts 22 towards one end of the pan 19 under the weight of condensate in the cavity.

Figures 3, 4:
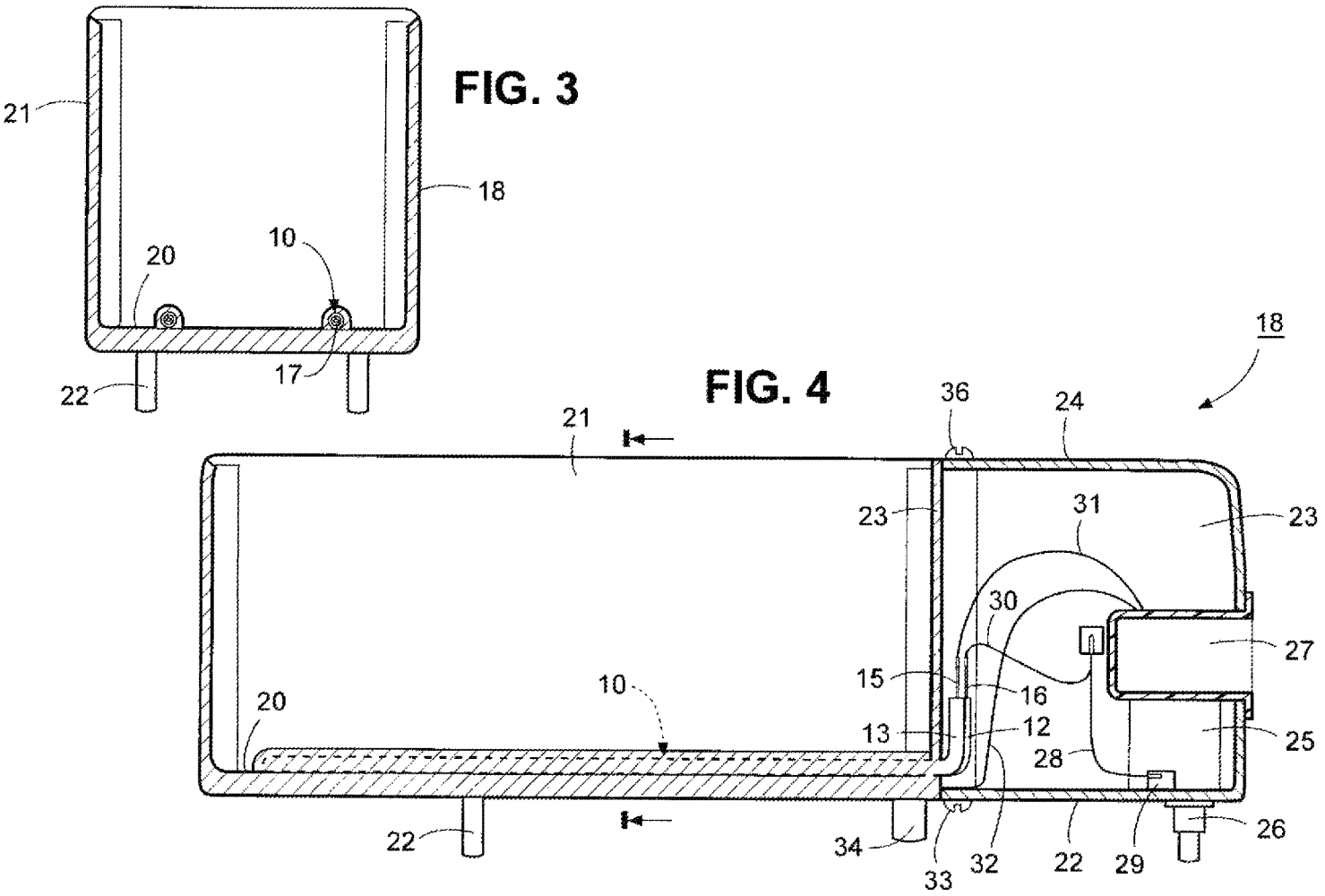
FIG. 3 illustrates a cross-sectional view of the condensate evaporator taken on line 3-3 of FIG. 2.
FIG. 4 illustrates a longitudinal cross-sectional view of the condensate evaporator of FIG. 1.

Referring to FIGS. 2, 3 and 4, the heating element 10 is cast into the floor 20 of the pan 19 during casting of the pan. Consequently, the unit of pan and heating element can be economically manufacture as opposed to being separate pieces that require subsequent assembly operations. As indicated in FIG. 3, the heating element 10 is cast into the topside of the floor 20 but may alternatively be cast into the underside of the floor 19.

Figure 5:
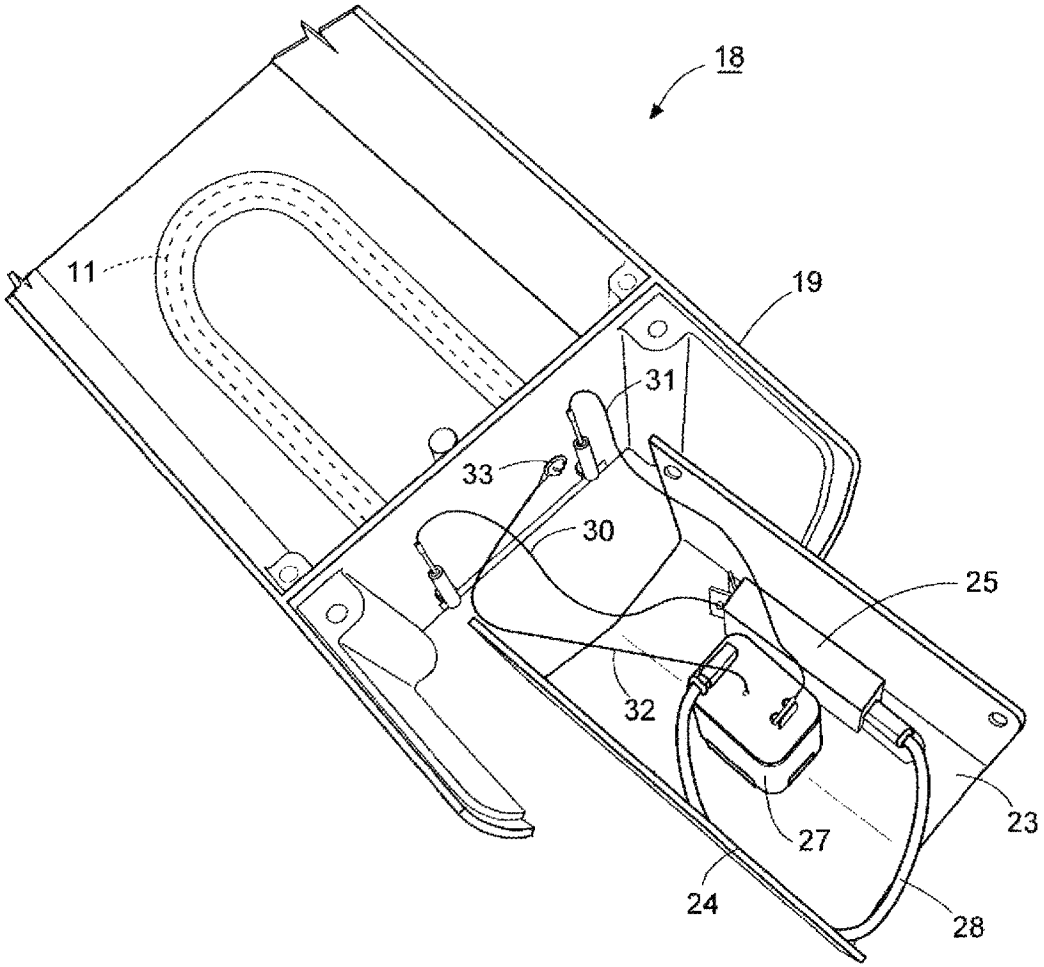
FIG. 5 is perspective view of the condensate evaporator of FIG. 1 with an exposed end.

Referring to FIGS. 4 and 5, one end of the pan 19 is bifurcated with a pair of parallel flanges 23 that slidingly receive a removable U-shaped housing 24 that is secured in place by screws 36 as described in U.S. patent application Ser. No. 12/806,571. Together with the two flanges 23, the housing 24 provides an enclosed compartment at the end of the pan 19 in which a switch 25 is mounted. This switch 25 includes a plunger 26 that extends through the bottom of the compartment. In addition, a power inlet 27, such as a T12-X035 male snap-in power inlet, is mounted within the compartment and has an exposed entry in the face of the evaporator 18 to receive a power cord plug in a conventional manner.

The power inlet 27 is connected via a lead 28 to a COM contact 29 of the switch 25; the switch 25 has N.O. contact connected via a lead 30 to one end 15 of the wire 14 of the heating element 10; and the other end 16 of the wire 14 of heating element 10 is connected to the power inlet 27 via a lead 31 to complete a circuit. A third lead 32 from the power inlet 27 is connected to the pan 19 by a screw 33 to serve as a ground.

As illustrated in FIG. 4, the heating element 10 is cast with the pan 19 so that the ends 12, 13 of the tube 11 are exposed within the compartment defined by the housing 23 so that the ends 15, 16 of the electrical wire 14 can be accessed by the leads 30, 31.

Referring to FIG. 4, the underside of the pan 19 is also provided with a pair of cast on posts 34 at the corners of the pan 19 adjacent the housing 23 that are of shorter extent than the posts 22 about which the pan 19 may pivot when sufficient water is in the cavity of the pan 19.

When placed on a flat support surface, the pan 19 is supported at three points, namely by the two intermediately disposed posts 22 and the plunger 26 of the switch 25. The posts 22 and the plunger 26 define a triangular array on the underside of the pan 19 for supporting the pan 19 on the flat surface.

The plunger 26 of the switch 25 is spring loaded by a spring (not shown) that has a spring constant which is sufficient to hold the pan 19 in the horizontal position on a flat surface when the pan 19 is empty but insufficient to prevent the pan 19 from pivoting under the added weight of a predetermined amount of condensate in the pan 19 about the fulcrum provided by the two posts 22.

As condensate begins to fill the cavity of the pan 19, the weight of the condensate causes the plunger 26 to begin to depress towards an actuation point thereby allowing the pan 19 to pivot about the two posts 22 in the direction of the end of the pan 19 in which the plunger 26 is located. As the weight of the water increases, the amount of retraction of the plunger 26 into the switch 25 increases.

Once the plunger 26 has retracted to an actuation point, the switch 25 closes and power is delivered to the heating element 10 causing the heating element 10 to heat the pan 19 and, thus, the condensate within the pan 19.

As the condensate evaporates from the pan 19, the weight of water within the pan 19 begins to decrease thereby allowing the pan to pivot under the force of the spring on the plunger 26 of the switch 25. At some point, the plunger 26 is extended from the switch 25 an amount sufficient to cause the switch 25 to "open" and, thus, interrupt the power supply to the heating element 10.

The invention thus provides a condensate evaporator that can be economically manufactured and one that requires a minimum of parts.

What is claimed is:

1. A condensate evaporator for refrigeration apparatus comprising:

a pan having a floor, upstanding walls extending from said floor to define a cavity for receiving condensate therein and a first pair of posts on an underside of said floor for pivoting of said pan on a surface about a horizontal axis passing through said posts towards one end of said pan under the weight of condensate in said cavity;

a heating element integral with said floor for heating condensate in said cavity to a point of evaporation;

a plunger type push button switch mounted at said one end of said pan, said switch having a movably mounted plunger for movement between an extended position corresponding to a raised position of said end of said pan relative to said surface and a retracted position corresponding to a lowered position of said end of said pan relative to said surface; and an electrical circuit electrically connecting said heating element and said switch to an electrical supply whereby electrical power is supplied to said heating element with said plunger in said retracted position thereof and electrical supply is interrupted to said heating element with said plunger in said extended position thereof.

2. The condensate evaporator as set forth in claim 1 further comprising a second pair of posts on said underside of said pan, each said post of said second pair of posts being disposed at a corner of said pan and being of shorter length than said first pair of posts.

3. The condensate evaporator as set forth in claim 2 wherein said heating element includes a U-shaped copper tube within said floor of said pan and an electrically conductive wire extending through said tube and having each end thereof extending from said pan and connected to said electrical circuit.

4. The condensate evaporator as set forth in claim 3 wherein said wire is coiled within said tube.

* * * * *